US006787248B1

(12) United States Patent
Liu

(10) Patent No.: US 6,787,248 B1
(45) Date of Patent: Sep. 7, 2004

(54) STRUCTURE ON A BI-COLOR RUST-PROOF BARRIER LAYER OF A TOOL HEAD

(76) Inventor: Wen-chih Liu, No. 16, Lane 15, Ho-li Street, Taiping City, Taichung (TW)

( * ) Notice: Subject to any disclaimer, the term of this patent is extended or adjusted under 35 U.S.C. 154(b) by 0 days.

(21) Appl. No.: 10/700,456

(22) Filed: Nov. 5, 2003

(51) Int. Cl.[7] ..... B32B 3/00

(52) U.S. Cl. ..... 428/615; 428/666; 428/680; 428/687; 428/458; 428/461; 428/467; 428/927; 428/935

(58) Field of Search ..... 428/615, 666, 428/680, 687, 458, 461, 467, 927, 935

(56) References Cited

U.S. PATENT DOCUMENTS 5,230,965 A * 7/1993 Cole et al. ..... 428/935

* cited by examiner

*Primary Examiner*—Robert R. Koehler
(74) *Attorney, Agent, or Firm*—Rabin & Berdo, P.C.

(57) ABSTRACT

This invention relates to a structure on a bi-color rust-proof barrier layer of a tool head, mainly used to form a surrounding recessed section marked with indication of a size, a model, a trademark and the like on a surface of a tool head (a metallic object) so that the structure on the rust-proof barrier layer painted with the different two colors is provided between the recessed section and the peripheral surface, thereby highlighting the indication marked at the recessed section so as to increase the distinctions of said object from other object.

3 Claims, 5 Drawing Sheets

STRUCTURE ON A BI-COLOR RUST-PROOF BARRIER LAYER OF A TOOL HEAD

FIELD OF THE INVENTION

This invention relates to a structure on a bi-color rust-proof barrier layer of a tool head, mainly used to form a recessed section on a surface of a metallic object so that the structure on the rust-proof barrier layer painted with the different two colors is provided between the recessed section and the peripheral surface.

BACKGROUND OF THE INVENTION

According to this present invention, the surface of the metallic object is coated with an electroplated layer or a dyed layer in order to form a barrier layer on the metallic object for achievement of the rust-proof performance. In a step of applying the barrier layer on the metallic object, a chromatism of the barrier layer is derived to emphasize a distinction between the products.

Referring now to FIG. 1 and FIG. 4, a diagram is shown for the steps of applying a self-color rust-proof barrier layer on the surface of the metallic object through a known skill; first, a properly cut "metallic base material 10" is used and then formed into a "specified product 11" through a lathe or a milling, and impurities on the surface of the material 10 are cleaned away through a working procedure of "sand blasting" or "vibration grinding", heated through a "heat treatment" for hardness enhancement, and finally put in an electroplating bath or in a dyeing tank so as to be applied with the rust-proof "electroplated layer" or the "dyed layer", thereby being formed into a "finished product"; the "finished product" formed with the processing steps only may optionally into a single "hue-dyed" or "hue-electroplated" product with a more monotonous texture of vision but without a structure of two colors.

Referring now to FIG. 2 and FIG. 4, a diagram is shown for the steps of applying the self-color rustproof barrier layer on the surface of the metallic object through the known skill. First, the properly cut "metallic base material 10" is used and then formed into the "specified product 11" through the lathe or the milling, and after impurities on the surface of the material 10 are cleaned away through the working procedure of "sand blasting" or "vibration grinding" heated through the "heat treatment" for hardness enhancement, covered with a sheath 13 in a portion (a screwdriver's head 12) required for no electroplating and then put in the electroplating bath for "electroplating treatment" so that the body 11 of the screwdriver may be beforehand formed with the electroplated layer, and finally uncovered and then put in the dyeing tank for the "dyeing treatment", in which only the head 12 of the screwdriver may be dyed because the surface of the head body 11 of the screwdriver has been formed with an electroplated layer, thereby being formed with a 2-segment structure of two colors.

Referring now to FIG. 3 and FIG. 4, a diagram is shown for the steps of applying the self-color rustproof barrier layer on the surface of the metallic object through the known skill. First, the properly cut "metallic base material 10" is in advance put in the electroplating bath for "electroplating treatment" so as to be formed with the electroplated layer and formed into the "specified product 11" through the lathe or the milling, and after impurities on the surface of the material 10 are cleaned away, made through the working procedure of "vibration grinding", heated through the "heat treatment" for hardness enhancement, and finally put in the dyeing tank for the "dyeing treatment", in which only the latched or milled portion (the head 12 of the screwdriver) may be dyed because the surface of the head body 11 of the screwdriver has been formed with an electroplated layer, thereby being formed with a 2-segment structure of two colors.

From the steps of the known skills shown in FIGS. 2 and 3, although the rust-proof layer of two-color structure may be formed on the surface of the metallic object, only a stagger colored structure with two segments may be provided; however, it is monotonous in the texture of vision.

Referring now to FIG. 5, an outside view of a nowadays widely used sleeve tool; especially, general manufacturers provide a strip of recessed section 21 on a product before shipped as an indication area of a size, a model, or a trademark; when the specified product "sleeve tool 20" is made in the step of the known skill shown in FIG. 1, only the single hue-electroplated or hue-dyed structure may be formed on the surface of the sleeve tool 20 but may not highlight the texture of vision of the strip of the recessed section 21.

Moreover, said provided strip of the recessed section 21 is placed at the surface of the "sleeve tool 20" as the specified product, so the bi-color structure may not be formed on the surface of the specified product and on its recessed section 21 in the steps of the known skill shown in FIG. 2 and FIG. 3.

This inventor is engaged in designing and manufacturing the related hand tools, through a try and improvement in many ways, finally making come into being this invention provided with the structure of electroplated color at the recessed section of the metallic object, and of electroplated color at the peripheral surface that are different from each other.

SUMMARY OF THE INVENTION

This invention is mainly to provide the recessed section on the surface of the metallic object so that the electroplating hue of the recessed section may be different from that of the peripheral surface, highlighting the marking texture quality of the recessed section and further enhancing the difference of the appearance of the product from that of other products.

DESCRIPTIONS OF THE PREFERRED EMBODIMENTS

For you examiner to further know and identify yourself with the technical descriptions, features, and effectiveness of this invention, preferred embodiments are described as follows accompanied with drawings.

Figure 1:
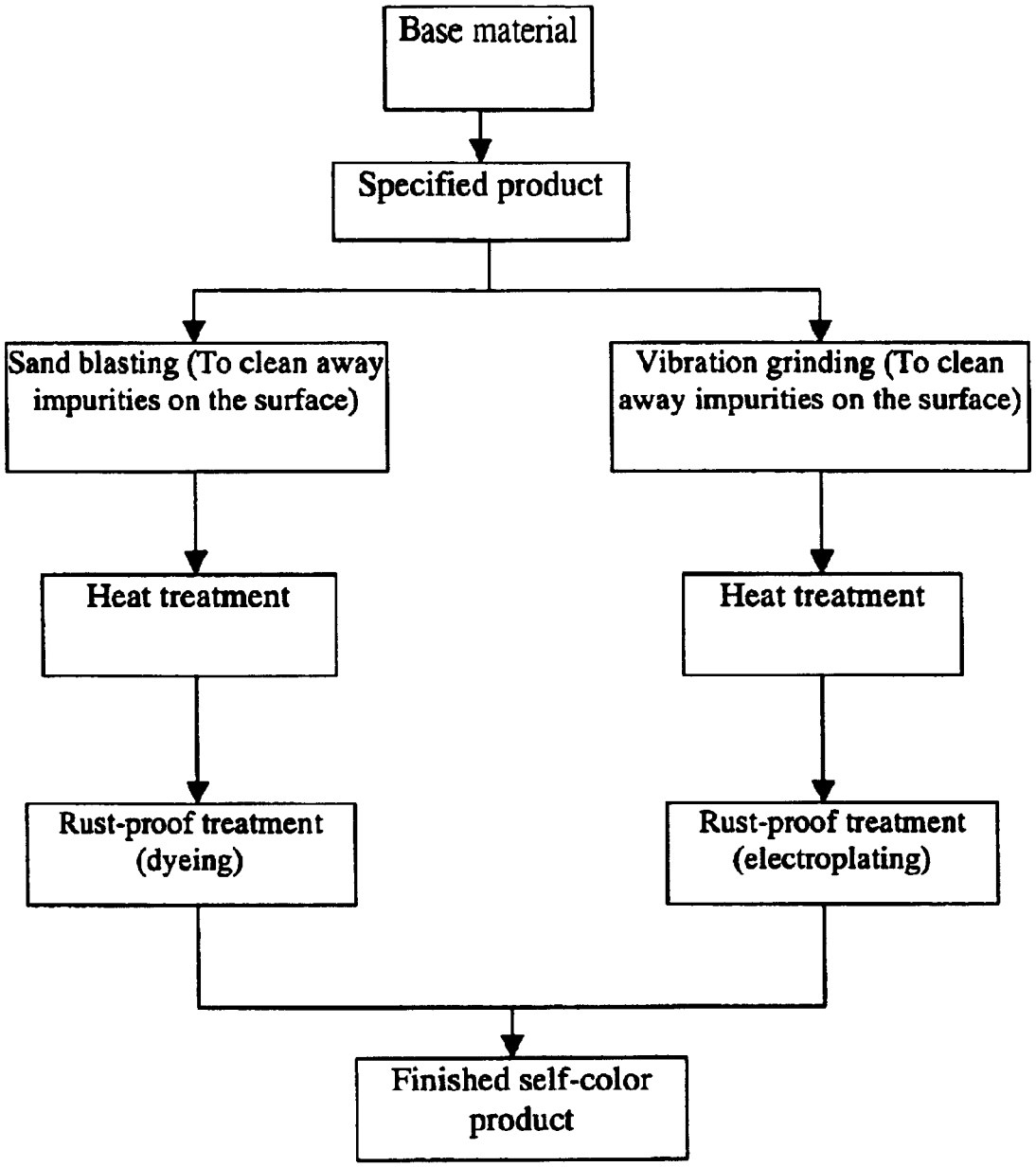
FIGURE 1 PRIOR ART
FIG. 1 shows a schematic drawing of a step of applying a self-color rust-proof barrier layer on a surface of a metallic object through a known skill.
Figure 2:
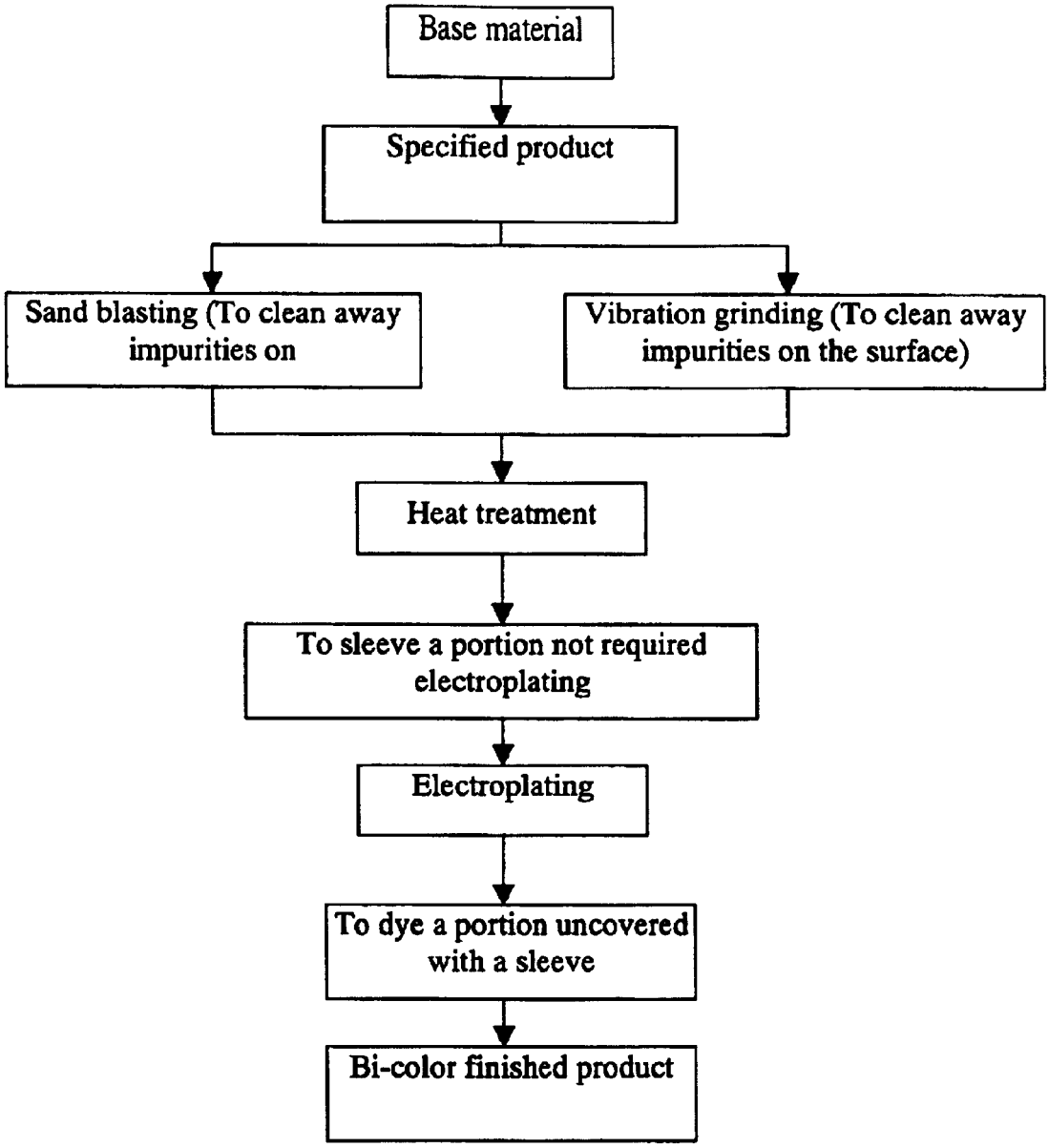
FIGURE 2 PRIOR ART
FIG. 2 shows a schematic drawing of the step of applying a bi-color rust-proof barrier layer on the surface of the metallic object through the known skill.
Figure 3:
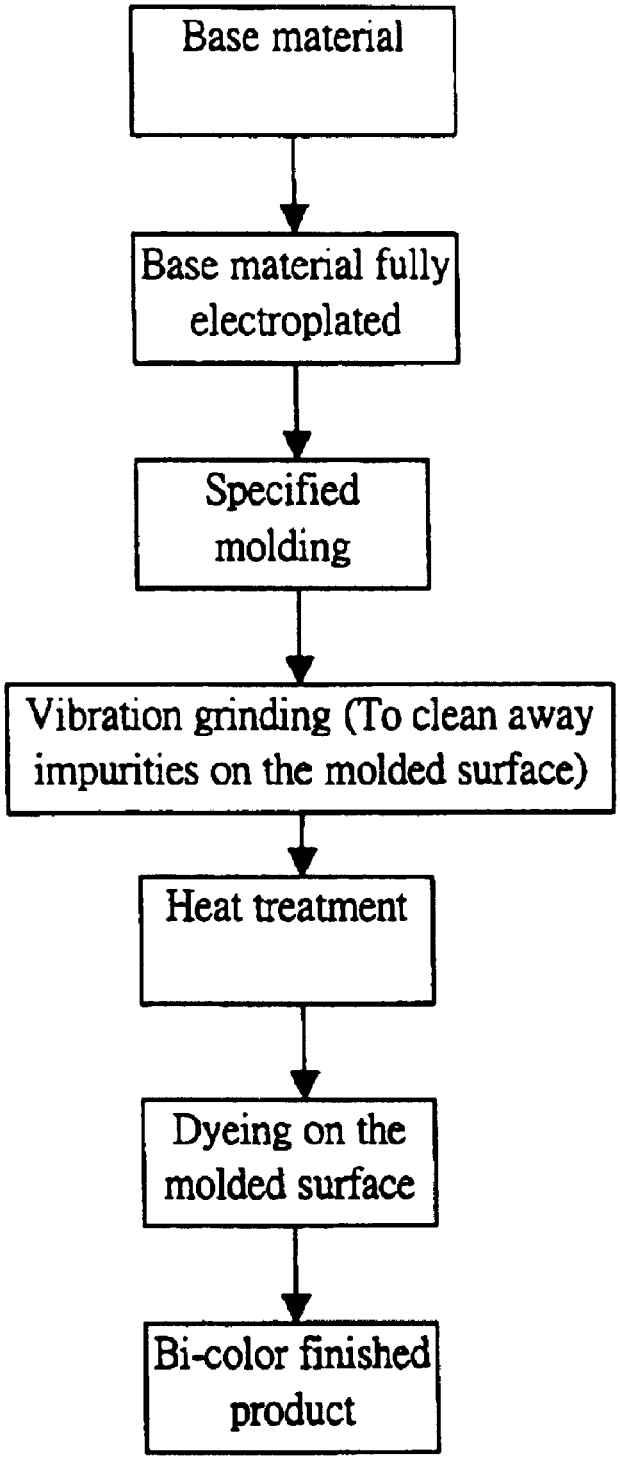
FIGURE 3 PRIOR ART
FIG. 3 shows another schematic drawing of the step of applying a bi-color rust-proof barrier layer on the surface of the metallic object through the known skill.
Figure 4:
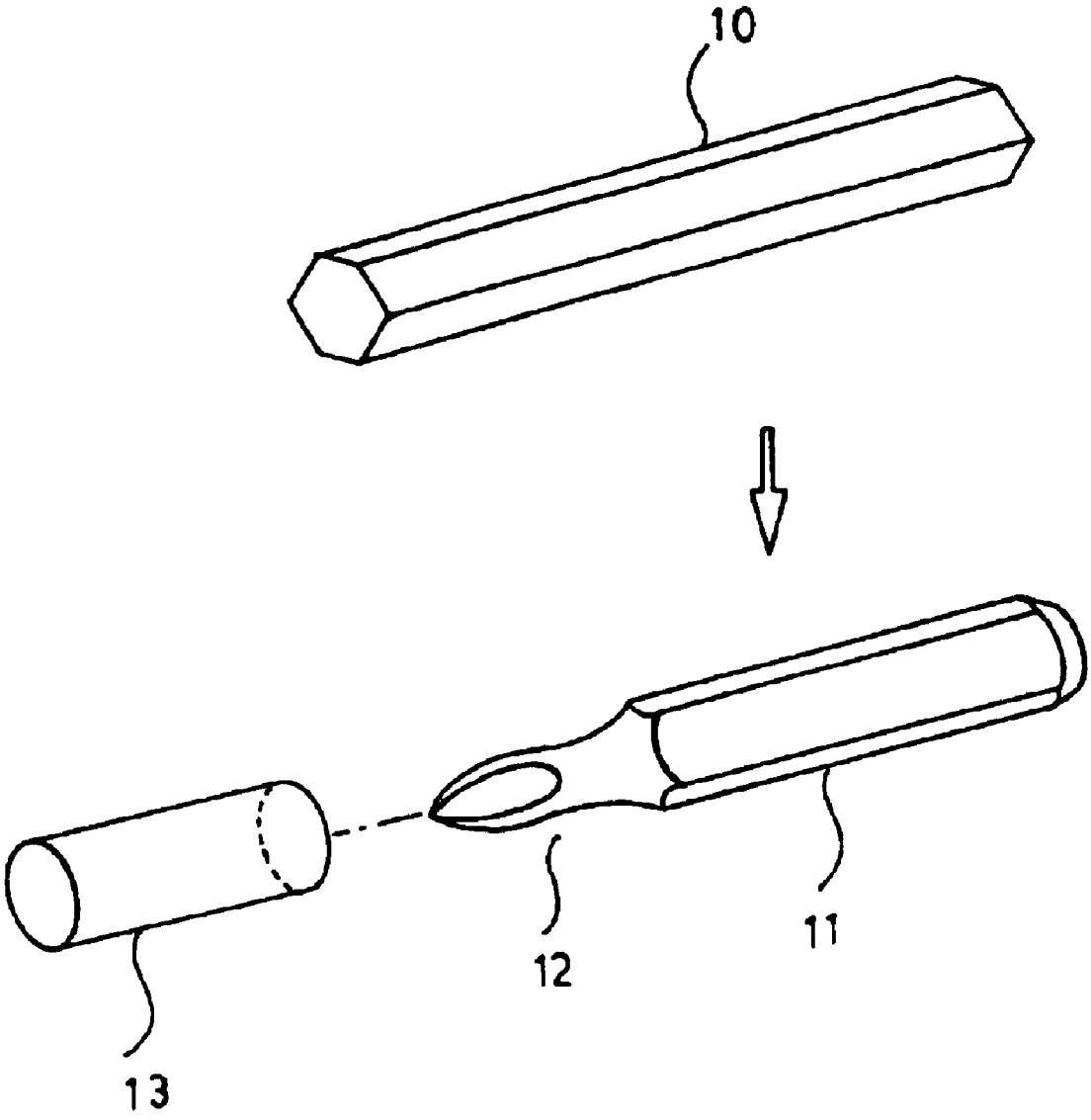
FIG. 4 shows a 3D schematic view of a conventional screwdriver head being formed into a finished product.
Figure 7:
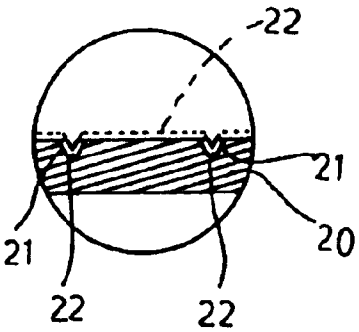
FIG. 7 shows a schematic view of implementation of the bi-color structure according to this invention (removal of a rust-proof electroplated or dyed layer on a surface of the sleeve tool).
Figure 6:
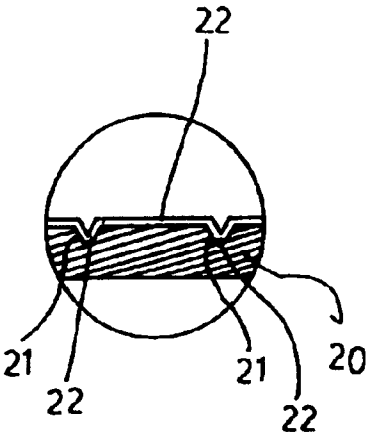
FIG. 6 shows an enlarged drawing of portion A of FIG. 5.
Figure 8:
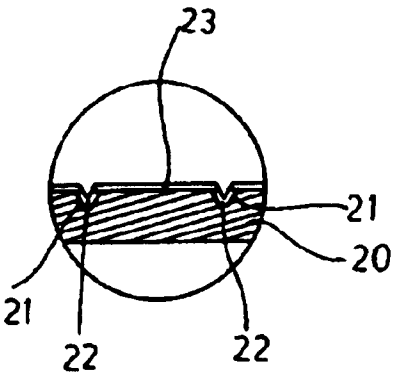
FIG. 8 shows a schematic view of completion of the bi-color structure according to this invention.
Figure 5:
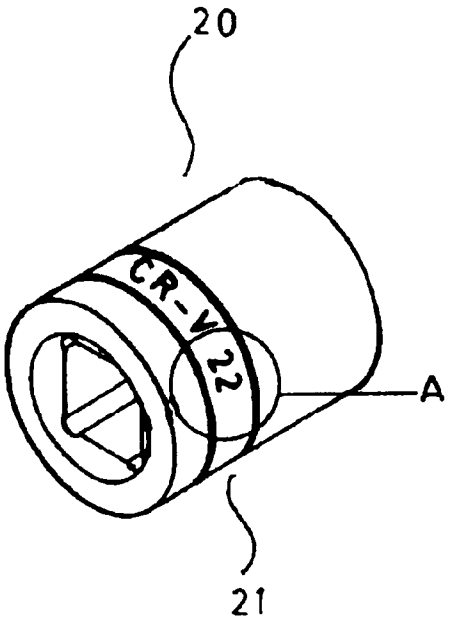
FIG. 5 shows an outside view of a conventional sleeve tool.

First of all, referring to FIGS. 5 and 6, the sleeve tool 20 according to this invention is formed with a specification in a general manufacturing process, of which the surface is marked with the size, the model, the trademark and the like that are placed at the strip of the surrounding recessed section 21, and after the impurities on the surface of the tool is cleaned away through the sand blasting or vibration grinding, the tool is heated through the heat treatment for enhancement of the hardness and lain in the electroplating bath for the "electroplating treatment" or in the dying tank for the "dyeing treatment" so that the surrounding surface and the recessed section 21 are attained with the rust-proof electroplated layer or dyed layer 22 (this skill is the one continually used in the step of the known skill for the self-color product of metallic object shown in FIG. 1); referring to FIG. 7, this invention is characterized in that the rust-proof electroplated or dyed layer 22 on the surface of the sleeve tool 20 is removed with a grinder so that the previous rust-proof electroplated or dyed layer 22 is kept in the recessed section 21; therefore, when the sleeve tool 20 is again put in the electroplating bath for the electroplating treatment or in the dyeing tank for the dyeing treatment, especially the recessed section 21 is formed with the previous electroplated or dyed layer 22 so that the section 21 may not again formed with a next electroplated or dyed layer, but a new electroplated or dyed layer 23 may be attained only after the previous layer is removed (as shown in FIG. 8).

The nickel (NI) of the electroplating materials may be golden, the chromium (CR) may be of platinous or black, and the dye may be black; from these features, if the sleeve tool 20 is first treated with a layer electroplated with the golden chromium and next re-treated with a layer electroplated with the black chromium, then the surface of the sleeve tool 20 appears black, namely said sleeve tool 20 being attained with the bi-color structure with the black surface serving as a foil to the golden recessed section 21.

The aforementioned embodiments are used only to explain this invention but not to confine this invention, and the color change of the bi-color structure or the sequence change of the rust-proof treatment, for example, should be included in the category of this invention.

To sum up, the appearance of the bi-color structure may indeed be formed in the bi-color rust-proof barrier layer of the tool head after the surface of the tool head is treated for the rust-proof request so that the value of product may be increased and the differences of the product from others may be created; therefore, the patent was not applied according to law.

What is claimed is:

1. A bi-color rust-proof barrier layer structure of a tool head, especially a bi-color rust-proof barrier layer structure of which a surface is formed with a strip of recessed surrounding section marked with a size, a model, trademark and the like, which is characterized in that a surrounding surface of the tool head and the strip of surrounding recessed section are in advance electroplated or dyed with the rust-proof barrier layer of a specified color and then the rust-proof barrier layer on the surface of the tool head is removed so that the strip of surrounding recessed section is still maintained with the color of the rust-proof barrier layer before treated; after the tool head is put in an electroplating bath for one more "electroplating on another barrier layer" or in a dyeing tank for one more "dying on another barrier layer" so that another colored barrier layer may be formed on the surface with a portion provided with the rust-proof barrier layer removed before, thereby allowing the color of the rust-proof barrier layer of the tool head serving as a foil to the different 2-color structure of the strip of surrounding recessed section.

2. The bi-color rust-proof barrier layer structure of the tool head according to claim 1, wherein the surface of the tool head is formed with the recessed section for implementation of the rust-proof barrier layer structure of different two colors.

3. The bi-color rust-proof barrier layer structure of the tool head according to claim 1, wherein the bi-color rust-proof barrier layer structure may be implemented as an electroplated layer with a dyed layer, an electroplated layer with an electroplated layer, or a dyed layer with a dyed layer.

* * * * *